US006373190B1

(12) United States Patent
Tsuruoka et al.

(10) Patent No.: US 6,373,190 B1
(45) Date of Patent: Apr. 16, 2002

(54) REAR PLATE UNIT OF PLASMA DISPLAY PANEL HAVING BARRIER RIBS OF REDUCING HEIGHTS

(75) Inventors: Yoshiaki Tsuruoka, Shinjuku-Ku; Nobuaki Kimura, Kawachi-Gun, both of (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/252,227

(22) Filed: Feb. 18, 1999

(30) Foreign Application Priority Data

Feb. 24, 1998 (JP) ..... 10-057375

(51) Int. Cl.[7] ..... H01J 17/49
(52) U.S. Cl. ..... 313/582; 313/586; 313/587
(58) Field of Search ..... 313/582, 583, 313/584, 585, 586, 587; 445/24, 25

(56) References Cited

U.S. PATENT DOCUMENTS 5,717,291 A * 2/1998 Kim ..... 313/586 X
5,747,939 A * 5/1998 Kim et al. ..... 313/586 X
6,034,475 A * 3/2000 Yoon ..... 313/586
6,051,928 A * 4/2000 Choi et al. ..... 313/586
6,149,482 A * 11/2000 Sakasegawa et al. ..... 445/24
6,184,621 B1 * 2/2001 Horiuchi et al. ..... 313/586

FOREIGN PATENT DOCUMENTS

JP 6-150832 A * 5/1994 ..... H01J/17/49
JP 10-188791 A * 7/1998 ..... H01J/9/02

* cited by examiner

*Primary Examiner*—Vip Patel
*Assistant Examiner*—Mack Haynes
(74) *Attorney, Agent, or Firm*—Parkhurst & Wendel, L.L.P

(57) ABSTRACT

This invention is a method of forming ribs of a plasma display panel by transfer-printing a glass paste on a glass substrate. The method comprises; forming a recess having a configuration corresponding to ribs arranged in parallel with each other and a joining element joining the ribs, filling the recess with the glass paste, and starting transfer-printing the glass paste on the glass substrate from a portion of the glass paste corresponding to the joining element filled in the recess. The method ensures that the glass paste comes off substantially completely from within the recess as it is being transfer-printed on the glass substrate and that the ribs are formed with high precision.

4 Claims, 3 Drawing Sheets

REAR PLATE UNIT OF PLASMA DISPLAY PANEL HAVING BARRIER RIBS OF REDUCING HEIGHTS

BACKGROUND OF THE INVENTION

1. Field of the Invention

This invention relates to the field of plasma display panels, in particular, to a method of forming ribs by transfer-printing a glass paste filled in a recess of a mold which has a configuration suitable for transfer-printing, and to a rear plate unit of a plasma display panel formed by the method.

2. Description of the Related Art

There are some methods of forming ribs of the plasma display panel, such as a screen printing method, a sandblasting method and so on.

In the screen printing method, a material for ribs (a glass paste) is made up by mixing of glass having a low melting point, a metal oxide such as alumina, vehicles and so on. The material for ribs is transfer-printed in a predetermined pattern on a glass substrate by a screen printing and then is dried up. The steps of printing and drying are repeated about 8 to 15 times so that the pattern for ribs are piled up to about 150$\mu$m. The piled pattern is then heated to form the intended ribs.

In the sandblasting method, the material for ribs described above is applied wholly on the glass substrate in such a manner that the thickness of the material for ribs is about 200$\mu$m. Then a dry-film-photoresist is attached on the surface of the material for ribs and is formed into a resist pattern by exposure to light. Then, the portions of the material for ribs not covered with the resist pattern are removed by sandblasting. Then, the resist pattern is melt and removed with caustic soda. The portions of the material for ribs covered with the resist pattern are then heated to form the intended ribs.

SUMMARY OF THE INVENTION

The screen printing method costs less because it can use the screen printing press. The screen printing method has also an advantage of small loss of the material because the material is printed only in a pattern corresponding to the intended ribs.

However, in conventional screen printing method, the heights of the ribs tend to be uneven, and some ribs may collapse as the printing is repeated. In addition, the conventional screen printing method is difficult to cope with fine pitches because there is a limitation to printing precision.

On the other hand, the sandblasting method has an advantage in that it can form higher precision patterns than the conventional screen printing method.

However, the sandblasting method does not make efficient use of the material for ribs, so that it can yield much waste.

A method of forming ribs by transfer-printing a glass paste filled in a recess of a mold on a glass paste has been suggested to solve the problems. For example, Japanese Patent Laid-Open 8-273537 describes a method comprising: providing a mold-sheet having a recess by using an intaglio, filling the recess of the mold-sheet with a glass paste, sticking the mold-sheet to a glass substrate, and removing the mold-sheet from the glass substrate to transfer-print the glass paste on the surface of the glass substrate. According to the method, the ribs are formed with an increased efficiency in using the material, without producing a waste, at high speed and with high precision. The above method requires that the glass paste come off substantially completely from within the recess of the mold-sheet to transfer-print the glass paste on the glass substrate in a predetermined shape.

Therefore, the object of this invention is to provide a method of forming ribs of a plasma display panel wherein a glass paste comes off substantially completely from within a recess as the glass paste is being transfer-printed onto a glass substrate, and a rear plate unit of a plasma display panel whose ribs are formed by the method.

To achieve the above object, this invention is characterized by the following features. That is:

This invention is a method of forming ribs of a plasma display panel by transfer-printing a glass paste on a glass substrate, comprising: providing a mold recess having a configuration corresponding to ribs arranged in parallel with each other and a joining element joining the ribs; filling the recess with the glass paste; and starting transfer-printing the glass paste on the glass substrate from a portion of the glass paste corresponding to the joining element filled in the recess.

According to the invention, in the mold recess having the configuration corresponding to the ribs arranged in parallel with each other and the joining element joining the ribs, the transfer-printing operation of the glass paste onto the glass substrate is started from the portion of the glass paste filled in the recesses, corresponding to the joining element. That is, the joining element becomes a starting point for the transfer-printing. The ribs joined by the joining element are transfer-printed following the joining element because the forces for transfer-printing the ribs are generated by the transfer-printing of the joining element. Thus the method of forming ribs of a plasma display panel may achieve that the glass paste comes off substantially completely from within the recess as the glass paste is being transfer-printed onto the glass substrate.

The recess is preferably formed in a mold-sheet in such a manner that the recess has a configuration having an opposite concavo-convex relation with the ribs and the joining element.

The recess may be formed in a flexible roller-intaglio in such a manner that the recess has a configuration having an opposite concavo-convex relation with the ribs and the joining element.

The method of forming ribs of a plasma display panel preferably comprises: heating the transfer-printed glass paste for hardening.

This invention is also a rear plate unit of a plasma display panel comprising: a glass substrate; ribs arranged in parallel with each other on the substrate; and a joining element arranged on the substrate and joining the ribs.

According to the invention, as the joining element joins the ribs arranged in parallel with each other, the rear plate unit of a plasma display panel may be easily formed by the method of forming the ribs by transfer-printing the glass paste filled in the recess.

The joining element is preferably formed in a bank shape and joins end portions of the ribs. In this case, as the end portions of the ribs are joined by the joining element of the bank shape, the forming of the joining element has little restriction but much advantage. In addition, the joining element has a height which is preferably lower than heights of the ribs and is gradually reduced in a direction away from the end portions of the ribs.

The joining element may be formed in a sheet shape and joins lower portions of the ribs. In this case, as the lower portions of the ribs are joined by the joining element of the sheet-shaped, the joining element serves as a starting point for the transfer-printing and operates to generate the forces for transfer-printing the ribs following the joining element. In this case, the ribs have heights which are preferably gradually reduced toward the end portions of the ribs. In addition, in this case, the joining element is preferably provided on an address electrode to form a dielectric layer. Then, as the dielectric layer is formed on the address electrode by the sheet-shaped joining element, the step of only forming of the dielectric layer can be omitted.

BRIEF DESCRTPTION OF THE DRAWINGS

BEST MODE FOR CARRYING OUT THE INVENTION

Figure 1:
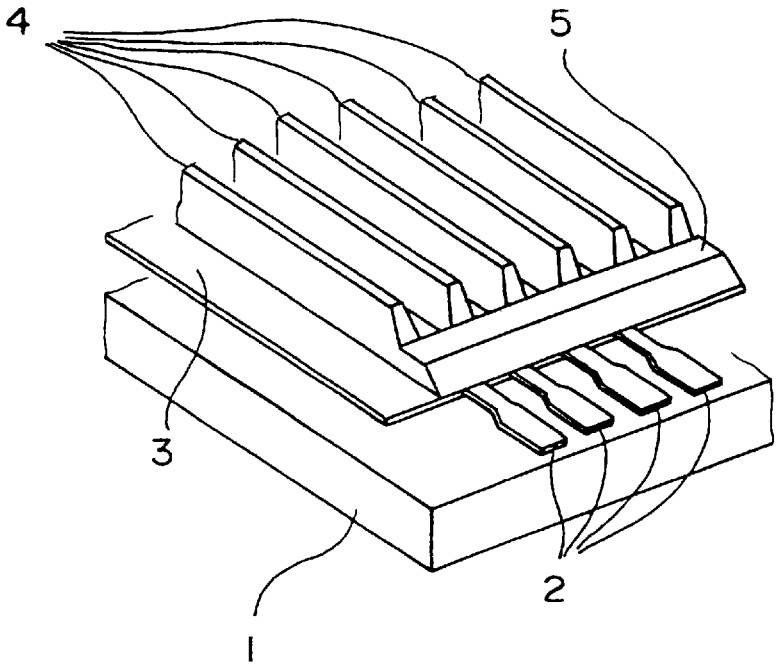
FIG. 1 is a perspective view of a first embodiment of the rear plate unit of a plasma display panel according to the invention.

Embodiments of the invention will now be described in more detail with reference to FIGS. 1 to 7. FIG. 1 shows a first embodiment of the rear plate unit of a plasma display panel according to the invention. In FIG. 1, a numeral 1 designates a glass substrate, 2 terminals of address electrodes, 3 a dielectric layer, 4 ribs and 5 a bank-shaped joining element. The glass substrate 1, the address electrodes and the dielectric layer 3 are formed before the ribs 4 and the joining element 5 are formed. The ribs 4 and the joining element 5 are formed at the same time (as will be described later).

As shown in FIG. 1, the ribs 4 arranged in parallel with each other are joined at their end portions by the joining element 5. The joining element 5 has a bank shape, that is, it has a flat portion and an inclined portion extending in parallel with each other. The height of the joining element 5 in the portion thereof adjacent the ribs 4 is lower than the heights of the ribs 4 and is gradually reduced in a direction away from the end portions of the ribs 4. This makes transfer-printing from the side of the joining element 5 smooth and stable.

The dielectric layer 3 does not cover the terminals 2 of the address electrodes, but covers bodies of the address electrode connected to the terminals 2. Thus, the address electrodes are concealed except for the terminals 2 so that the bodies are not shown in FIG. 1. The ribs 4 and the bank-shaped joining element 5 are formed by transfer-printing a glass paste filled in a recess of a mold on the surface of the dielectric layer 3.

To give an example, in the case of FIG. 1, the height of each rib 4 is 120$\mu$m, the pitch of the ribs 4 is 350$\mu$m and the height of the joining element 5 is 80$\mu$m. In addition, the thickness of the dielectric layer 3 on the glass substrate is 20$\mu$m, the thickness of each electrode is 5$\mu$m and the pitch of the electrodes is 350$\mu$m.

Besides the embodiment in FIG. 1, the following variations are suitable for better transfer-printing. That is, the height of the bank-shaped joining element 5 shown in FIG. 1 is gradually reduced in such a manner that its cross section has a linearly sloped line, but could be gradually reduced in such a manner that its cross section has an arcuate shape. Furthermore, the thickness of the end portion of the joining element 5 is substantially 0$\mu$m in the case of FIG. 1, but could be 20 to 40 $\mu$m at the thinnest portion.

Figure 2:
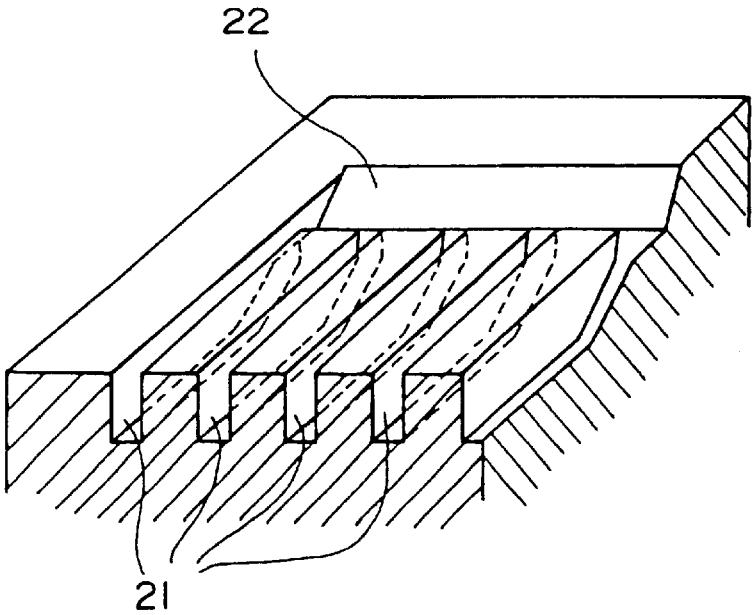
FIG. 2 is a perspective view of a recess for filling a glass paste therein to form the ribs in FIG. 1.

FIG. 2 shows a recess of a mold for being filled with a glass paste to form the ribs 4 in FIG. 1. In FIG. 2, numeral 21 designates recess portions for the ribs and numeral 22 designates a recess portion for the joining element. The shape of the recess portions 21 for the ribs corresponds to the shape of the ribs 4 in the opposite concavo-convex or complementary relation. That is, the vacant spaces of the recess portions 21 correspond to the solid portions of the ribs 4 and the solid portions beside the recess portions 21 correspond to the vacant spaces beside the ribs 4. Similarly, the shape of the recess portion 22 for the joining element corresponds to the shape of the bank-shaped joining element 5 in an opposite concavo-convex or complementary relation. That is, the vacant spaces of the recess portion 22 corresponds to the solid portion of the joining element 5 and the solid portion defining the recess portion 22 corresponds to the vacant space adjacent the joining element 5.

Another joining element 5 could be provided to join the opposite end portions (not shown) of the ribs 4, which are the ending side of the transfer-printing.

Figure 3:
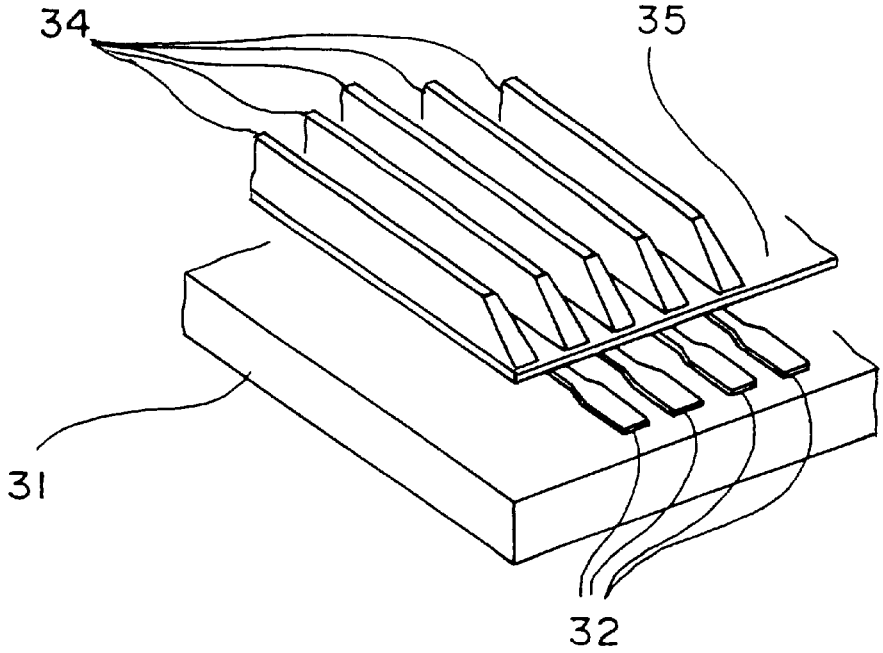
FIG. 3 is a perspective view of a second embodiment of the rear plate unit of a plasma display panel according to the invention.

Another embodiment will be explained. FIG. 3 shows a second embodiment of the rear plate unit of a plasma display panel according to the invention. In FIG. 3, a numeral 31 designates a glass substrate, 32 terminals of address electrodes, 34 ribs and 35 a sheet-shaped joining element. The sheet-shaped joining element 35 also serves as a dielectric layer. The glass substrate 31 and the address electrodes 32 are formed before the ribs 34 and the joining element 35 are formed. The ribs 34 and the joining element 35 are formed at the same time, so that there is formed a dielectric layer having the same function as the dielectric layer 3 in FIG. 1.

As shown in FIG. 3, the ribs 34 arranged in parallel with each other are joined at their lower portions by the sheet-shaped joining element 35. Each rib 34 has a sloped shape in the end portion on the side of the terminals 32 of the address electrodes. That is, the height of each rib 34 in the end portion is gradually reduced toward the side of the terminals 32 of the address electrodes. This makes transfer-printing from the portion of the joining element 35 on the side of the terminals 32 of the address electrodes smooth and stable.

The sheet-shaped joining element 35 does not cover the terminals 32 of the address electrodes, but covers bodies of the address electrode connected to the terminals 32. Thus, the address electrodes are concealed except for the terminals 32 so that the bodies are not shown in FIG. 3. The ribs 34 and the sheet-shaped joining element 35 are formed by transfer-printing a glass paste filled in a recess of a mold, on the surface of the glass substrate 31 on which the address electrodes are formed.

To give an example, in the case of FIG. 3, the height of each rib 34 is 120$\mu$m, the pitch of the ribs 34 is 350$\mu$m and the thickness of the sheet-shaped joining element 35, serving as a dielectric layer, is 20$\mu$m. In addition, the thickness of each electrode on the glass substrate is 5μm and the pitch of the electrodes is 350μm.

Figure 4:
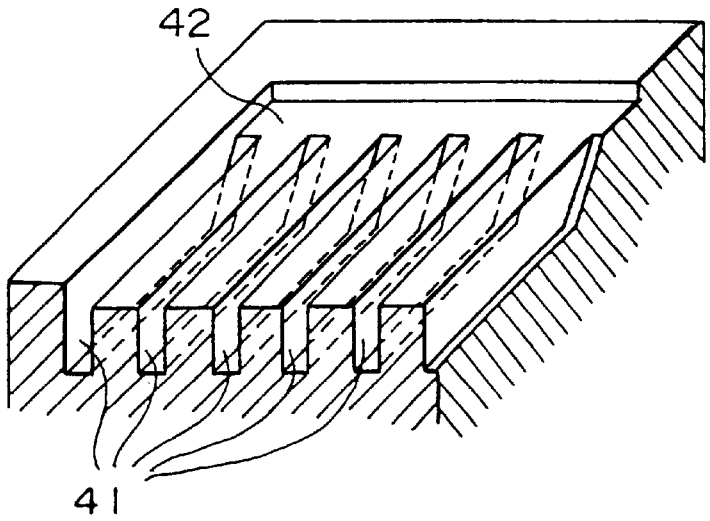
FIG. 4 is a perspective view of a recess for filling a glass paste therein to form the ribs in FIG. 3.

FIG. 4 shows a recess of a mold for being filled with a glass paste to form the ribs 34 in FIG. 3. In FIG. 4, a numeral 41 designates recess portions for the ribs and a numeral 42 designates a recess portion for a joining element. The shape of the recess portions 41 for the ribs corresponds to the shape of the ribs 34 in an opposite concavo-convex or complementary relation. That is, the vacant spaces of the recess portions 41 correspond to the solid portions of the ribs 34 and the solid portions beside the recess portions 41 correspond to the vacant spaces beside the ribs 34. Similarly, the shape of the recess portion 42 for the joining element corresponds to the shape of the sheet-shaped joining element 35 in an opposite concavo-convex or complementary relation. That is, the vacant spaces of the recess portion 42 corresponds to the solid portion of the joining element 35 and the solid portion adjacent recess portion 42 corresponds to the vacant space adjacent the joining element 35.

Then, a method of forming ribs of the rear plate unit of a plasma display panel will be described below. The first method of forming ribs comprises: (1) forming a mold-sheet with a recess having a configuration that has an opposite concavo-convex or complementary relation with the ribs and the joining element; (2) filling the recess of the mold-sheet with a glass paste; (3) closely applying the mold-sheet to the glass substrate and removing the former from the latter to transfer-print the glass paste onto the glass substrate; and (4) heating the transfer-printed glass paste for hardening.

If the joining element for ribs is formed in a sheet-shaped and serves as a dielectric layer for the plasma display, the ribs and the dielectric layer are heated for hardening at the same time. If electrodes on the glass substrate are not formed before the transfer-printing, the electrodes, the ribs and the dielectric layer are heated for hardening at the same time. These procedures are advantageous to simplify the step for hardening.

According to the method, the transfer-printing operation of the glass paste onto the glass substrate is started from the portion of the glass paste filled in the recess, corresponding to the joining element. That is, a mold-sheet is removed from the portion of the glass paste filled in the recess, corresponding to the joining element.

Figure 5:
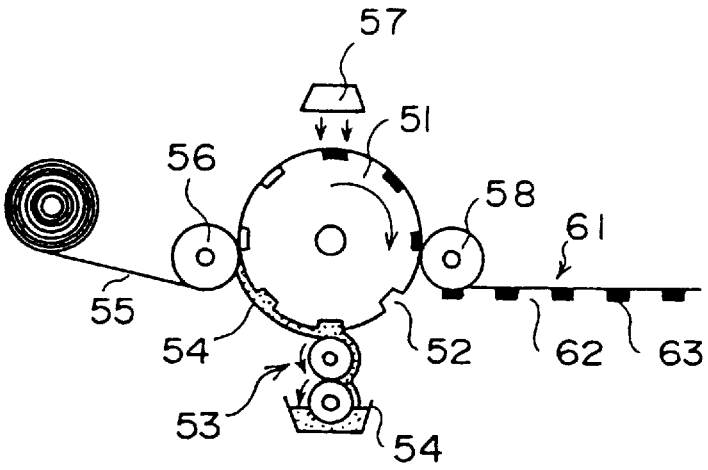
FIG. 5 is a schematic side view of an apparatus for manufacturing a mold-sheet.

FIG. 5 shows an apparatus for manufacturing the mold-sheet. In FIG. 5, a numeral 51 designates a roller-intaglio with a configuration having the same concavo-convex relation with the ribs and the joining element and a numeral 52 denotes recesses of the roller-intaglio 51. A numeral 53 designates a glass paste applying unit, 54 an ionization radiation hardening resin, 55 a film substrate, 56 a pressing roller, 57 an ionization radiation unit and 58 a removing roller. A numeral 61 designates a mold-sheet, 62 recesses of the mold-sheet 61 and 63 protrusions (hardening resin) on the mold-sheet 61.

The ionization radiation hardening resin 54 is applied on the surface of the roller-intaglio 51 by the applying unit 53, so that the recesses 52 in the surface of the roller-intaglio 51 are filed with the resin 54. On the other hand, the film substrate 55 is introduced and closely pressed to the roller-intaglio 51 by the pressing roller 56. At that time, the ionization radiation hardening resin 54 remains in the recesses 52 of the roller-intaglio 51. The roller-intaglio 51 rotates in the direction shown by an arrow in FIG. 5, so that the resin 54 in the recesses 52 is hardened when the resin 54 passes below the ionization radiation unit 57 while the resin is closely applied to the film substrate. The roller-intaglio 51 rotates further, so that the film substrate 55 is removed from the roller-intaglio 51 by the removing roller 58. At that time, the hardened resin 54 in the recesses 52 adheres to the film substrate 55. Thus, the intended mold-sheet 61 is produced.

The mold-sheet produced by the above steps is used as a mold. The recesses 62 of themold-sheet 61 are filled,by a method such as a blade-coat method, with a glass frit comprising PbO and so on and /or a glass paste comprising heat resistant pigments dispersed in an organic vehicle. The mold-sheet 61 is closely applied to the surface of the glass substrate on the side of the recesses 62 before the filled glass paste is dried up. The glass paste filled in the recesses 62 sticks to the glass substrate due to the moisture of the vehicle solvent. Then the glass paste is transfer-printed on the glass substrate when the mold-sheet 61 is removed from the glass substrate.

Figure 6:
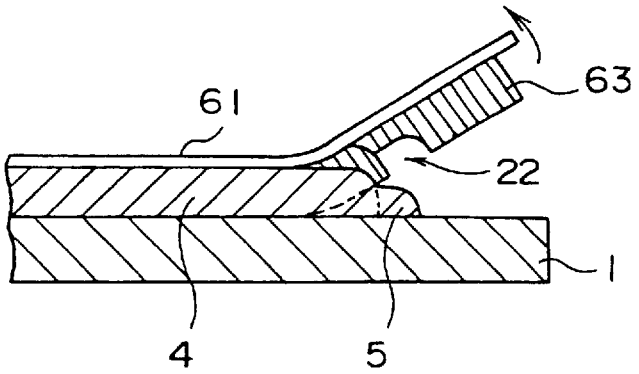
FIG. 6 is a schematic side view of the ribs and the joining element in FIG. 1 in the first stage of transfer-printing.
Figure 7:
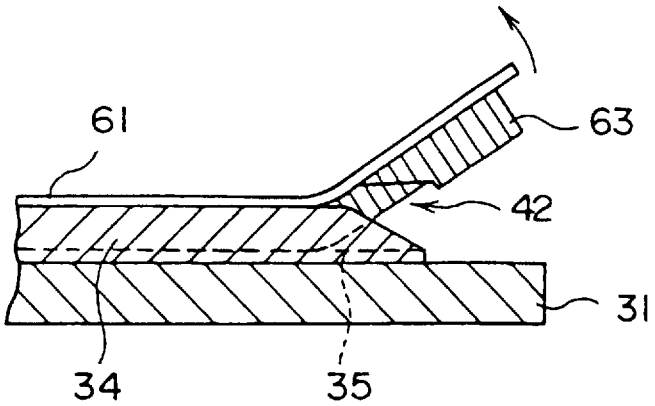
FIG. 7 is a schematic side view of the ribs and the joining element in FIG. 3 in the first stage of transfer-printing.

FIG. 6 schematically shows a side view in section of the ribs and the joining element in FIG. 1 at the first stage of transfer-printing. FIG.7 schematically shows a side view in section of the ribs and the joining element in FIG. 3 at the first stage of transfer-printing. As shown in FIGS. 6 and 7, removing of the mold-sheet 61 is started from a portion of the glass paste corresponding to the joining element filled in the recesses. At that time, the joining element sticks to the glass substrate due to the moisture more strongly than the ribs do because the joining element is subjected to the sticking by its overall surface. Therefore, the joining element becomes a starting point for the transfer-printing. All the ribs joined by the joining element are transfer-printed following the joining element because the forces for transfer-printing the ribs are generated by the transfer-printing of the joining element.

Next, another method of forming ribs will be described. The second method of forming ribs is a method of directly transfer-printing the glass paste filled in the roller-intaglio onto the glass substrate without using the mold-sheet. The second method comprises: (1) forming a flexible roller-intaglio with a recess that has a configuration having an opposite concavo-convex relation with the ribs and the joining element; (2) filling the recess of the roller-intaglio with a glass paste while the roller-intaglio is rotated and removing surplus glass paste by applying a squeegee to the surface of the roller-intaglio; (3) positioning and closely applying the rotating roller-intaglio to a supplied glass substrate; (4) removing the roller-intaglio from the glass substrate to transfer-print the glass paste onto the glass substrate; and (5) heating the glass substrate having the transfer-printed glass paste for hardening in a heating furnace or the like.

If the joining element for ribs is formed in a sheet-shaped and serves as a dielectric layer for plasma display, the ribs and the dielectric layer are heated for hardening at the same time. If electrodes on the glass substrate are not formed before the transfer-printing, the electrodes, the ribs and the dielectric layer are heated for hardening at the same time. These procedures are advantageous to simplify the step for hardening.

According to the method, the transfer-printing of the glass paste onto the glass substrate is started from the portion of the glass paste corresponding to the joining element, filled in the recess in the roller-intaglio.

Thus, the method of forming ribs of a plasma display panel according to the invention ensures that the glass paste comes off substantially completely from within the recess when being transfer-printed onto the glass substrate and that the ribs is formed with high precision.

The method is also advantageous to simplify the steps for forming ribs. First, the number of steps decreases by one if the ribs and the dielectric layer are printed on the glass substrate at the same time. Second, the number of steps decreases by one if the ribs and the dielectric layer are heated for hardening at the same time. Furthermore, the number of steps decreases by two if the electrodes, the ribs and the dielectric layer are heated for hardening at the same time.

The rear plate unit of a plasma display panel according to the invention can be easily formed with high precision as the glass paste comes off substantially completely from the recesses when being transfer-printed.

If the end portions of the ribs are joined by the joining element having a bank shape, the forming of the joining element has a little restriction but much advantage.

If the lower portions of the ribs are joined by the joining element having a sheet-shaped, the joining element serves as a starting point for the transfer-printing and operates to generate the forces for transfer-printing the ribs following the joining element.

If the joining element serves as a dielectric layer formed on the address electrodes, the step of only forming of the dielectric layer can be omitted.

What is claimed is:

1. A rear plate unit of a plasma display panel comprising:

a glass substrate;

ribs arranged in parallel with each other on the substrate; and a joining element arranged on the substrate and joining the ribs;

wherein the joining element is formed in a bank shape and joins ends portions of the ribs, and the joining element has a height that is lower than heights of the ribs and is gradually reduced in a direction away from the end portions of the ribs.

2. A rear plate unit of a plasma display panel according to claim 1, wherein the ribs have heights that are gradually reduced toward the end portions of the ribs.

3. A rear plate unit of a plasma display panel according to claim 1, wherein the joining element is provided on an address electrode to form a dielectric layer.

4. A rear plate unit of a plasma display panel comprising:

a glass substrate for the plasma display panel;

electrodes arranged in parallel with each other on the glass substrate;

a member formed on the substrate by integrating ribs arranged in parallel with each other, with a sheet-shaped dielectric layer ; and a joining element arranged on the substrate and joining the ribs;

wherein the electrodes and the ribs are parallel to each other, the joining element is formed in a bank shape and joins end portions of the ribs, and the joining element has a height that is lower than heights of the ribs and is gradually reduced in a direction away from the end portions of the ribs.

* * * * *